US006189559B1

(12) United States Patent
Williams

(10) Patent No.: US 6,189,559 B1
(45) Date of Patent: Feb. 20, 2001

(54) PORTABLE TROUGH FOR WATER HEATERS

(76) Inventor: James Williams, 1005 E. Lake St., Peoria, IL (US) 61614

( * ) Notice: Under 35 U.S.C. 154(b), the term of this patent shall be extended for 0 days.

(21) Appl. No.: 09/544,438

(22) Filed: Apr. 7, 2000

(51) Int. Cl.[7] ..... F24H 9/16
(52) U.S. Cl. ..... 137/312; 122/504; 220/571
(58) Field of Search ..... 137/312, 313; 126/344; 122/504; 222/108; 220/571

(56) References Cited

U.S. PATENT DOCUMENTS 4,765,360 * 8/1988 Baird ..... 137/312
4,909,274 * 3/1990 Rodriquez ..... 137/312
5,715,569 * 2/1998 Dickey ..... 15/415.1
5,794,609 * 8/1998 Grant ..... 122/504 X

* cited by examiner

*Primary Examiner*—Kevin Lee

(57) ABSTRACT

A portable trough for water heaters for reducing the amount of time and effort taken to replace heating elements in water heaters. The portable trough for water heaters includes a container having side walls, a bottom wall which has a depressed back portion for retaining lime from the water heater, a front end wall, a back end, and an open top; and also includes a rubber seal member disposed at and covering the back end of the container; and further includes a hose attachment member disposed through the front end wall of the container and extending outwardly of the container and having a bore extending therethrough into the container and being adapted to connect to a water vacuum hose; and also includes a handle member securely attached to an exterior of the bottom wall of the container.

10 Claims, 2 Drawing Sheets

PORTABLE TROUGH FOR WATER HEATERS

BACKGROUND OF THE INVENTION

1. Field of the Invention

The present invention relates to a water trap for water heaters and more particularly pertains to a new portable trough for water heaters for reducing the amount of time and effort taken to replace heating elements in water heaters.

2. Description of the Prior Art

The use of water trap for water heaters is known in the prior art. More specifically, water trap for water heaters heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,715,569; U.S. Pat. No. 4,976,004; U.S. Pat. No. Des. 29,468; U.S. Pat. No. 5,054,160; U.S. Pat. No. 2,206,959; and U.S. Pat. No. Des. 368,996.

While these devices fulfill their respective, particular objectives and requirements, the aforementioned patents do not disclose a new portable trough for water heaters. The inventive device includes a container having side walls, a bottom wall which has a depressed back portion for retaining lime from the water heater, a front end wall, a back end, and an open top; and also includes a rubber seal member disposed at and covering the back end of the container; and further includes a hose attachment member disposed through the front end wall of the container and extending outwardly of the container and having a bore extending therethrough into the container and being adapted to connect to a water vacuum hose; and also includes a handle member securely attached to an exterior of the bottom wall of the container.

In these respects, the portable trough for water heaters according to the present invention substantially departs from the conventional concepts and designs of the prior art, and in so doing provides an apparatus primarily developed for the purpose of reducing the amount of time and effort taken to replace heating elements in water heaters.

SUMMARY OF THE INVENTION

In view of the foregoing disadvantages inherent in the known types of water trap for water heaters now present in the prior art, the present invention provides a new portable trough for water heaters construction wherein the same can be utilized for reducing the amount of time and effort taken to replace heating elements in water heaters.

The general purpose of the present invention, which will be described subsequently in greater detail, is to provide a new portable trough for water heaters which has many of the advantages of the water trap for water heaters mentioned heretofore and many novel features that result in a new portable trough for water heaters which is not anticipated, rendered obvious, suggested, or even implied by any of the prior art water trap for water heaters, either alone or in any combination thereof.

To attain this, the present invention generally comprises a container having side walls, a bottom wall which has a depressed back portion for retaining lime from the water heater, a front end wall, a back end, and an open top; and also includes a rubber seal member disposed at and covering the back end of the container; and further includes a hose attachment member disposed through the front end wall of the container and extending outwardly of the container and having a bore extending therethrough into the container and being adapted to connect to a water vacuum hose; and also includes a handle member securely attached to an exterior of the bottom wall of the container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable trough for water heaters which has many of the advantages of the water trap for water heaters mentioned heretofore and many novel features that result in a new portable trough for water heaters which is not anticipated, rendered obvious, suggested, or even implied by any of the prior art water trap for water heaters, either alone or in any combination thereof.

It is another object of the present invention to provide a new portable trough for water heaters which may be easily and efficiently manufactured and marketed.

It is a further object of the present invention to provide a new portable trough for water heaters which is of a durable and reliable construction.

An even further object of the present invention is to provide a new portable trough for water heaters which is susceptible of a low cost of manufacture with regard to both materials and labor, and which accordingly is then susceptible of low prices of sale to the consuming public, thereby making such portable trough for water heaters economically available to the buying public.

Still yet another object of the present invention is to provide a new portable trough for water heaters which provides in the apparatuses and methods of the prior art some of the advantages thereof, while simultaneously overcoming some of the disadvantages normally associated therewith.

Still another object of the present invention is to provide a new portable trough for water heaters for reducing the amount of time and effort taken to replace heating elements in water heaters. Yet another object of the present invention is to provide a new portable trough for water heaters which includes a container having side walls, a bottom wall which has a depressed back portion for retaining lime from the water heater, a front end wall, a back end, and an open top; and also includes a rubber seal member disposed at and covering the back end of the container; and further includes a hose attachment member disposed through the front end wall of the container and extending outwardly of the container and having a bore extending therethrough into the container and being adapted to connect to a water vacuum hose; and also includes a handle member securely attached to an exterior of the bottom wall of the container.

Still yet another object of the present invention is to provide a new portable trough for water heaters that is convenient and easy to use.

Even still another object of the present invention is to provide a new portable trough for water heaters that prevents a lot of unwanted mess during the replacing of heating elements in water heaters.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
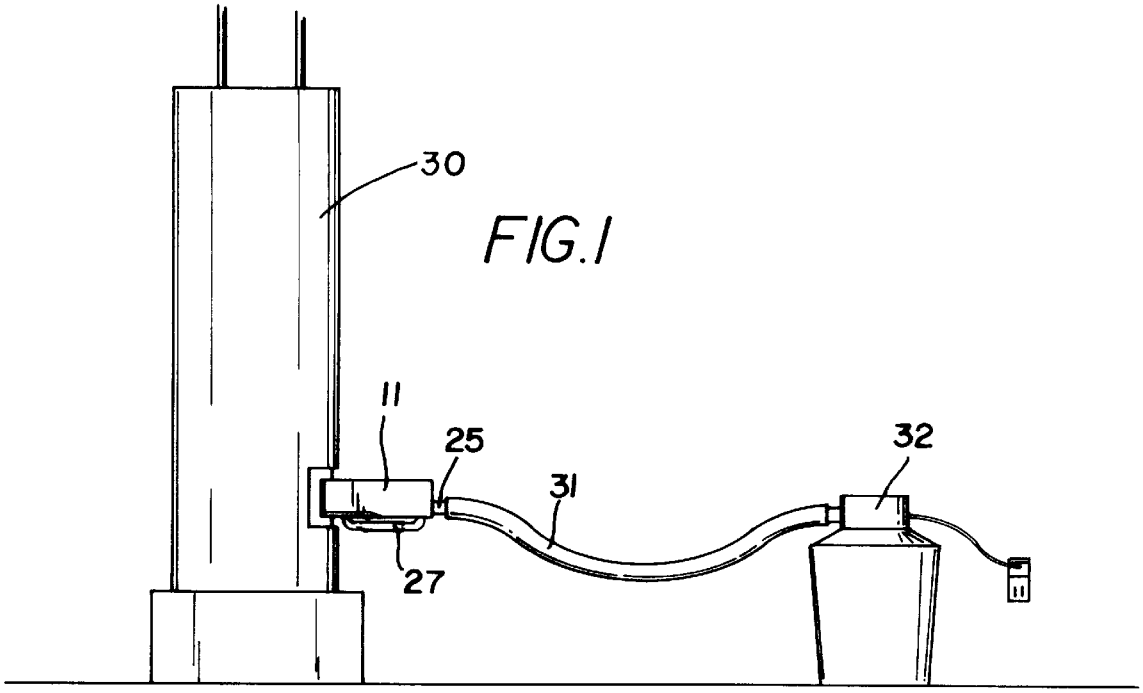
FIG. 1 is a side elevational view of a new portable trough for water heaters according to the present invention and being put to use.
Figure 2:
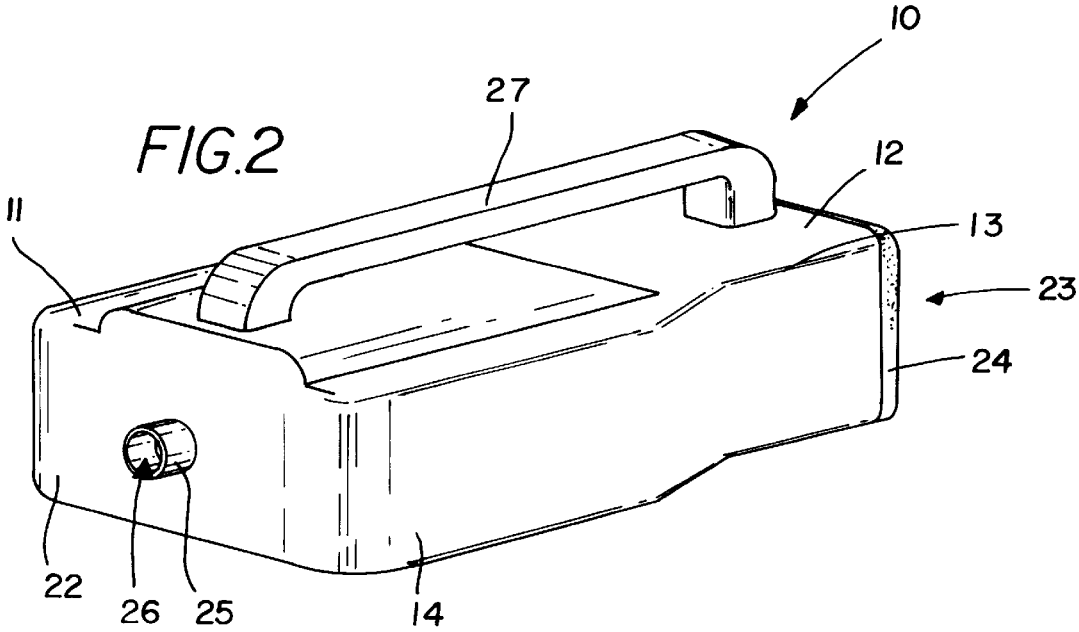
FIG. 2 is a bottom perspective view of the present invention.
Figure 3:
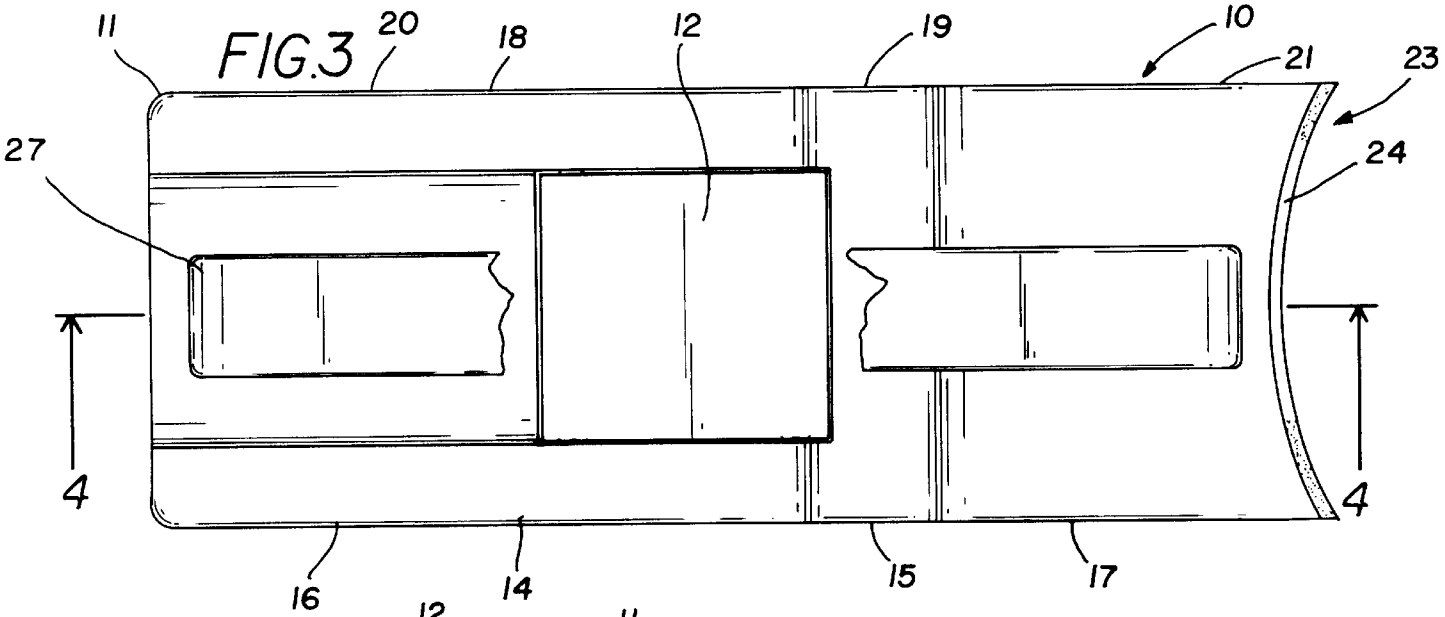
FIG. 3 is a bottom plan view of the present invention.
Figure 4:
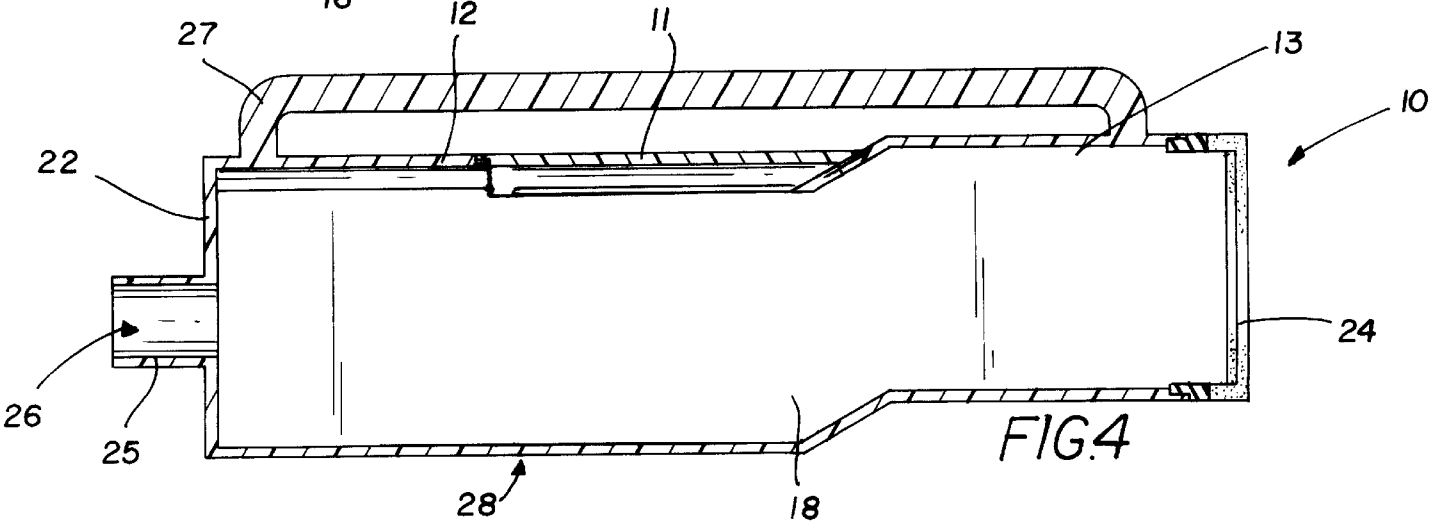
FIG. 4 is a cross-sectional view of the present invention.

With reference now to the drawings, and in particular to FIGS. 1 through 4 thereof, a new portable trough for water heaters embodying the principles and concepts of the present invention and generally designated by the reference numeral 10 will be described.

As best illustrated in FIGS. 1 through 4, the portable trough for water heaters 10 generally comprises a container 11 having a bottom wall 12, side walls 14,18, a front end wall 22, an open top 28, and a back end 23 and being adapted to fit into a water heater 30 below a heating element. The bottom wall 12 has a depressed back portion 13 which is adapted to retain lime from the water heater 30. Each of the side walls 14,18 has a middle portion 15,19 which is angled inwardly of the container 11 and has a back portion 17,21 and a front portion 16,20. The front portions 16,20 of the side walls 14,18 are spaced farther apart from one another than the back portions 17,21 of the side walls 14,18. The container 11 has a length of approximately 12½ inches and has a front portion with a width of approximately 6 inches and has a back portion with a width of approximately 3⅝ inches. The back portion 13 of the bottom wall 12 is depressed approximately 1 inch for effectively retaining lime draining from the water heater 30. A seal member 24 is securely and conventionally disposed at the back end 23 of the container 11 with the seal member 24 being essentially a rubber seal and having a thickness of approximately 1 inch and essentially covering the back end 23 of the container 11. A hose attachment member 25 is securely and conventionally disposed through the front end wall 22 of the container 11 and has a bore 26 extending therethrough into the container 11 and being adapted to be connected to a hose 31, in particular, a water vacuum hose. The hose attachment member 25 is spaced from the bottom wall 12 with the hose attachment member 25 being essentially a tubular member extending outwardly of the container 11. The hose attachment member 25 has a diameter of approximately 1¼ inches and has a length of approximately 2 inches. A handle member 27 is securely and conventionally attached to an exterior of the bottom wall 12 of the container 11.

In use, the user removes the cover of the water heater 30 and disconnects the wires to the heating element, and then inserts the back end 23 of the container 11 into the water heater 30 through the opening into the water heater 30 below the heating element so that when the heating element is removed, the water inside the water heater 30 will drain into the container 11 through the open top 28. A water vacuum 32 is attached to the hose attachment member 25 and the water being drained into the container 11 is sucked into the water vacuum 32.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable water trough for water heaters comprising:

a container having a bottom wall, side walls, a front end wall, an open top, and a back end and being adapted to fit into a water heater below a heating element;

a seal member securely disposed at said back end of said container;

a hose attachment member disposed through said front end wall of said container and having a bore extending therethrough into said container and being adapted to be connected to a hose; and a handle member securely attached to an exterior of said bottom wall of said container.

2. A portable water trough for water heaters as described in claim 1, wherein said bottom wall has a depressed back portion which is adapted to retain lime from the water heater.

3. A portable water trough for water heaters as described in claim 2, wherein said hose attachment member is spaced from said bottom wall.

4. A portable water trough for water heaters as described in claim 3, wherein said hose attachment member is essentially a tubular member extending outwardly of said container.

5. A portable water trough for water heaters as described in claim 4, wherein each of said side walls has a middle portion which is angled inwardly of said container and has a back portion and a front portion, said front portions of said side walls being spaced farther apart from one another than said back portions of said side walls.

6. A portable water trough for water heaters as described in claim 5, wherein said container has a length of approximately 12½ inches and has a front portion having a width of approximately 6 inches and has a back portion having a width of approximately 3⅝ inches.

7. A portable water trough for water heaters as described in claim 6, wherein said hose attachment member has a diameter of approximately 1¼ inches and has a length of approximately 2 inches.

8. A portable water trough for water heaters as described in claim 7, wherein said seal member is essentially a rubber seal and has a thickness of approximately 1 inch and essentially covers said back end of said container.

9. A portable water trough for water heaters as described in claim 8, wherein said back portion of said bottom wall is depressed approximately 1 inch for effectively retaining lime draining from a water heater.

10. A portable water trough for water heaters comprising:

a container having a bottom wall, side walls, a front end wall, an open top, and a back end and being adapted to fit into a water heater below a heating element, said bottom wall having a depressed back portion which is adapted to retain lime from the water heater, each of said side walls having a middle portion which is angled inwardly of said container and having a back portion and a front portion, said front portions of said side walls being spaced farther apart from one another than said back portions of said side walls, said container having a length of approximately 12½ inches and having a front portion with a width of approximately 6 inches and having a back portion with a width of approximately 3⅝ inches, said back portion of said bottom wall being depressed approximately 1 inch for effectively retaining lime draining from a water heater;

a seal member securely disposed at said back end of said container, said seal member being essentially a rubber seal and having a thickness of approximately 1 inch and essentially covering said back end of said container;

a hose attachment member disposed through said front end wall of said container and having a bore extending therethrough into said container and being adapted to be connected to a hose, said hose attachment member being spaced from said bottom wall, said hose attachment member being essentially a tubular member extending outwardly of said container, said hose attachment member having a diameter of approximately 1¼ inches and has a length of approximately 2 inches; and a handle member securely attached to an exterior of said bottom wall of said container.

* * * * *